US006684442B1

(12) United States Patent
Parker et al.

(10) Patent No.: US 6,684,442 B1
(45) Date of Patent: Feb. 3, 2004

(54) PROTECTIVE FOOT PAD, COMPOSITE AND METHOD OF MANUFACTURE

(75) Inventors: Camelia Joan Parker, 827 Weidner Ct. South, Buffalo Grove, IL (US) 60089; John Vernon Glenn, Heber Springs, AR (US)

(73) Assignee: Camelia Joan Parker, Arlington Heights, IL (US)

( * ) Notice: Subject to any disclaimer, the term of this patent is extended or adjusted under 35 U.S.C. 154(b) by 0 days.

(21) Appl. No.: 09/568,724

(22) Filed: May 11, 2000

(51) Int. Cl.[7] ..... A43D 11/00

(52) U.S. Cl. ..... 12/146 B; 12/142 R; 36/15; 36/11.5

(58) Field of Search ..... 36/106, 15, 25 R, 36/11.5, 71, 9 R, 9 A; 12/142 R, 146 R, 146 B, 146 BP, 146 BR, 142 F, 142 K, 142 Q, 142 T, 1 R, 1 F, 17 R; 156/230, 324, 289, 249, 238; 428/40.1

(56) References Cited

U.S. PATENT DOCUMENTS 1,980,621 A * 11/1934 Innis ..... 36/11.5
2,191,704 A * 2/1940 Bennett
2,599,359 A * 6/1952 Banks et al.
2,772,196 A * 11/1956 Pooley ..... 36/25 R
2,816,655 A * 12/1957 Crozier et al.
2,985,970 A * 5/1961 McCarthy ..... 36/11.5
3,059,350 A * 10/1962 Price ..... 36/106
3,099,026 A * 7/1963 Reid et al.
3,415,706 A * 12/1968 Ettre
3,554,835 A * 1/1971 Morgan
3,693,269 A * 9/1972 Guarrera ..... 36/15
3,733,721 A * 5/1973 Clemens ..... 36/32 R
3,903,620 A * 9/1975 Gillet ..... 36/15
4,030,212 A * 6/1977 Ito ..... 36/11.5
4,484,574 A * 11/1984 DeRusha et al.
4,925,724 A * 5/1990 Ogden
5,482,593 A * 1/1996 Kuhn et al.
5,542,198 A * 8/1996 Famolare ..... 36/15

* cited by examiner

*Primary Examiner*—M. D. Patterson
(74) *Attorney, Agent, or Firm*—Dillis V. Allen, Esq.

(57) ABSTRACT

A disposable protective foot pad, composite and its method of manufacture including a resilient planar foam base, an adhesive layer on one side of the base, carried by a film having another adhesive layer on its opposite side covered by a protective sheet. The foot pad composite is manufactured by feeding a web of elastomeric foam in contact with a double-sided film after one of two protective sheets is removed from one side of the film and thereafter simultaneously die cutting a plurality of protective foot pads from the foam web, film and protective sheet composite.

3 Claims, 3 Drawing Sheets

PROTECTIVE FOOT PAD, COMPOSITE AND METHOD OF MANUFACTURE

BACKGROUND OF THE INVENTION

There is a need in hospitals, athletic clubs, health clubs, rehabilitation facilities, health care facilities, hotels, and in fact even in the home environment for a low-cost, disposable foot protector.

There are presently available low-cost disposable cellulose paper slippers for this purpose, but these slippers do not provide an adequate barrier against bacteria and other foreign materials, and also are degradable when subjected to significant moisture, such as found in the bathing and shower environment.

There have, in the past, been provided a plurality of upperless footwear for a variety of purposes that include various attaching devices to other footwear, such as stockings.

The following is a list of United States Patents disclosing these footwear devices:

| Inventor | Pat. No. | Issue Date |
|---|---|---|
| Tranmal | 2,746,173 | May 22, 1956 |
| Meltzer | 2,772,488 | Dec. 4, 1956 |
| Bartels, et al. | 2,933,830 | Apr. 26, 1960 |
| Shecter, et al. | 2,948,971 | Aug. 16, 1960 |
| Saffir | 2,965,982 | Dec. 27, 1960 |
| Price | 3,059,350 | Oct. 23, 1962 |
| Cho | 4,497,070 | Feb. 5, 1985 |
| Safdie | 5,771,605 | June 30, 1998 |

The Tranmal, U.S. Pat. No. 2,746,173, shows a vacuum-held sandal that has a plurality of suction cups, such as at 8, in the top surface that lock the out-sole 1, 4, to the user's feet.

The Saffir, U.S. Pat. No. 2,965,982, shows a high heel shoe with a plurality of magnets, such as at 3, that attach the shoe to the user's foot with a plurality of ferro-magnetic elements that are bonded to the user's sock or foot.

The Price, U.S. Pat. No. 3,059,350, shows a strapless sandal that has a plurality of hook elements shown at 18 that snag on the user's stockings and hold the sandals to the feet.

It is a primary object of the present invention to ameliorate the problems noted above in detachable footwear and provide a low-cost, readily disposable, protective foot pad composite and its method of manufacture.

SUMMARY OF THE PRESENT INVENTION

In accordance with the present invention, a disposable protective foot pad composite and its method of manufacture are provided in an attempt to produce a very low-cost, mass producible, disposable pad readily attachable to the bottom of the human foot and one that provides an effective barrier to bacteria and moisture.

Toward these ends, the present disposable protective foot pad composite includes a planar foam base having an outer configuration conforming to a generic foot shape common to both the left and right foot, with a double-sided film attached on one side to the base with a protective sheet over the other side of the film. The double-sided film has a layer of adhesive on both sides and a protective sheet over both layers of adhesive. One of these protective sheets is removed prior to adhesion of the film to the foam base.

The foam pad composite is manufactured by feeding a web of planar elastomeric foam in contact with a double-sided film after one of two protective sheets is removed from one side of the film, and thereafter simultaneously die-cutting a plurality of protective foot pads from the foam web, film, and protective sheet composite.

Other objects and advantages of the present invention will appear more clearly from the following detailed description.

DETAILED DESCRIPTION OF THE PREFERRED EMBODIMENT

Figure 1:
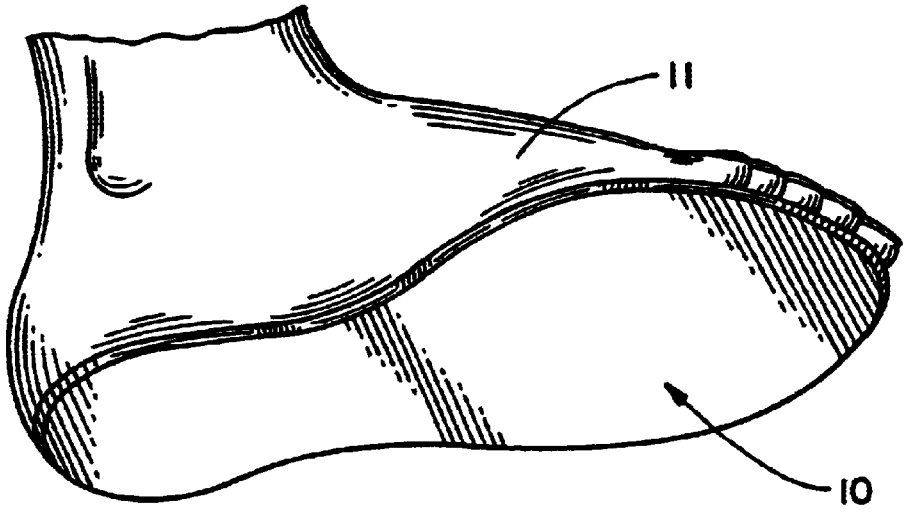
FIG. 1 is a perspective view of the present protective foot pad applied to the bottom of the human foot.

Defining the drawings, and particularly FIGS. 1 to 5, the present disposable foot pad protector composite generally designated by the reference numeral 10 as seen in FIG. 1, is attachable directly to the bare bottom or sole surface of the human foot 11 without any attaching means surrounding the upper or metatarsal area of the foot. The present protective foot pad 10 is secured to the sole of the foot by direct contact with the epidermal skin on the sole of the foot and does not require the use of an intermediate attaching mechanisms such as stockings.

Figure 2:
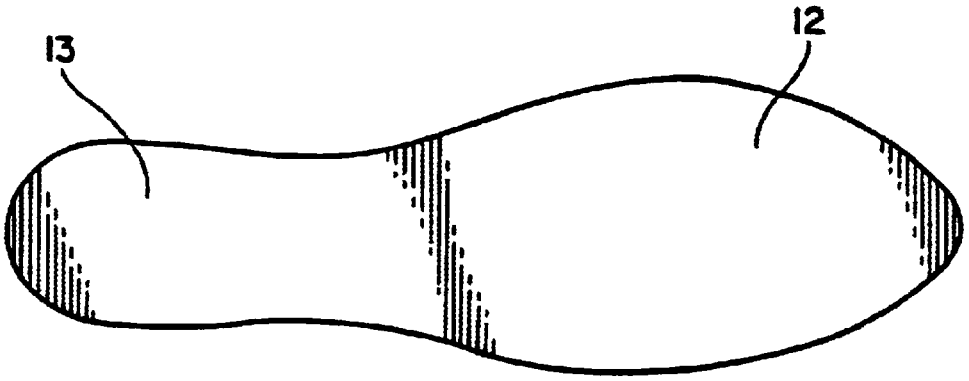
FIG. 2 is a top view of the protective foot pad illustrated in FIG. 1.

As seen in FIG. 2, the composite pad includes a wide toe portion 12, and a relatively narrower heel portion 13 that are generic to both the left foot and the right foot to decrease manufacturing costs and to reduce confusion of the user in application to his or her right or left feet.

Figure 3:
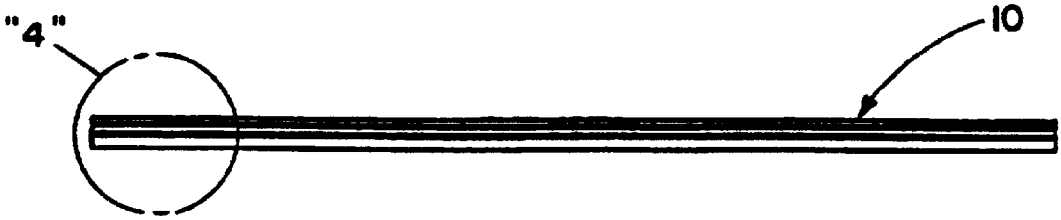
FIG. 3 is a side view of the protective foot pad illustrated in FIGS. 1 and 2.
Figure 4:
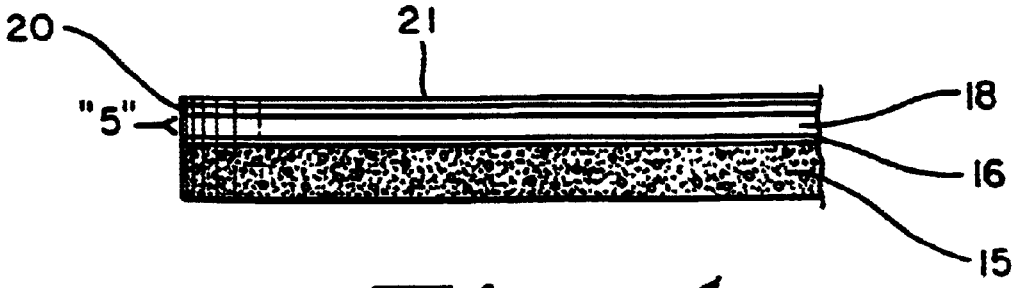
FIG. 4 is an enlarged fragmentary longitudinal section of the foot pad illustrated in FIGS. 1 to 3.

As seen in FIG. 3, the composite pad 10 has a uniform thickness throughout its length and as seen more clearly in FIG. 4, which is an enlarged fragmentary cross section of the foot pad composite 10, the composite 10 is seen to generally include a heavy uniform thickness foam sheet 15, a contact adhesive layer 16, a sheet film 18 that initially carries the adhesive layer 16, an adhesive layer 20 on the opposite side of film 18, and a protective sheet 21 that is removable from adhesive layer 20 to expose the adhesive layer 20 for attachment to the user's foot, and of course sheet 21 is designed to be removed by the ultimate user.

The foam sheet 15 is preferably a closed cell foam so that it does not act as a sponge for moisture and is in the range of 1/16th to 3/16ths inches in thickness.

One exemplary material for foam sheet 16 is urethane.

However, it should be understood that other similar foam products could be used and that urethane is merely one that has been found satisfactory for this purpose.

Figure 5:
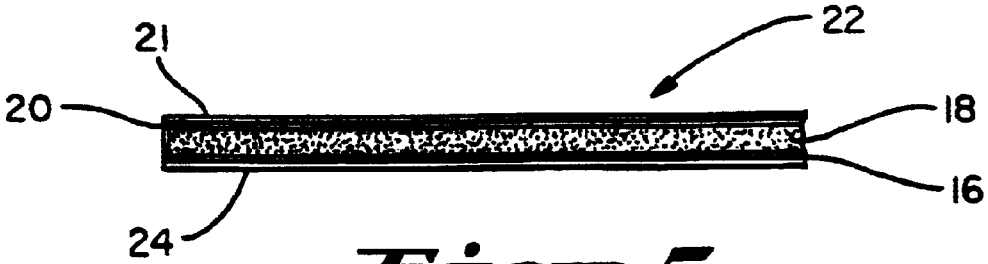
FIG. 5 is a sub-assembly view of the double-sided adhesive film utilized in making the foot pad composite with protective layers on both sides thereof.
Figure 8:
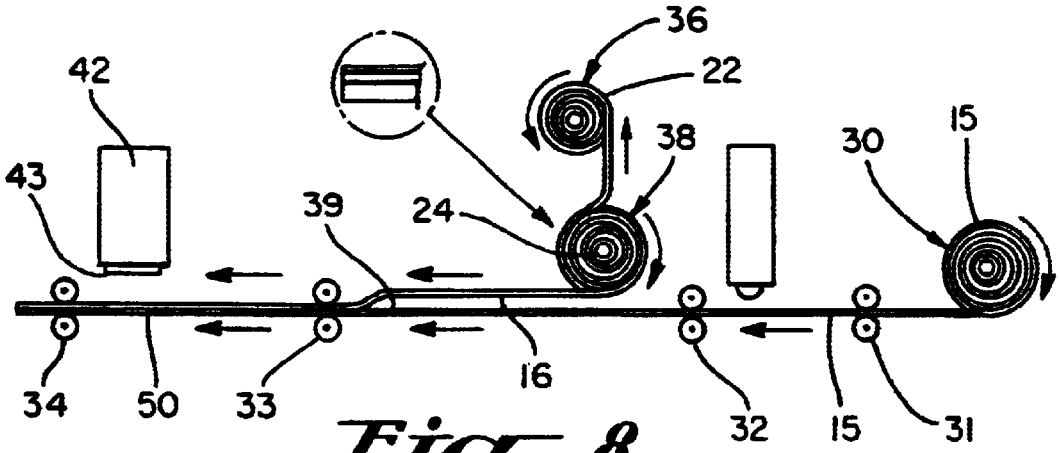
FIG. 8 is a schematic illustration of a web feed manufacturing system for the present protective foot pad composites.

In FIG. 5, a film composite 22 is illustrated, including film 18, adhesive layer 16, adhesive layer 20, and protective sheet 21, and a second protective sheet 24. Sheet 24, as will appear in connection with FIG. 8, is removed prior to the adhesion of layer 16 to one side of the foam 15. The film composite 22 is commercially available from 3M Manufacturing Corporation.

However, it should be understood that other double-sided film composites can be utilized as well.

While the use of a double-sided film composite 22 is the preferred embodiment because it facilitates the mass production of the present composite protective foot pads, and it eliminates certain manufacturing problems such as the non-uniform spraying of adhesive, it should be understood that the present invention, in its broadest aspect, with respect to the protective foot pad per se and not its method of manufacture, encompasses the application of adhesive to one side of the foam 15 without the use of film 18.

The method of manufacture of the present protective foot pad composite is illustrated in diagrammatic form in FIG. 8.

As seen, a roll 30 of uniform thickness elastomeric foam 15 is fed by roller sets 31, 32, 33, and 34 in a linear planar direction.

A second roll 36 of the film composite 22 is fed around roll 38 where sheet 24 is removed and rolled exposing adhesive layer 16 to top surface 39 of the foam 15. At rollers 33, the modified film composite 22 is joined to the foam 15 by the attachment of adhesive layer 16 to foam surface 39.

Figure 6:
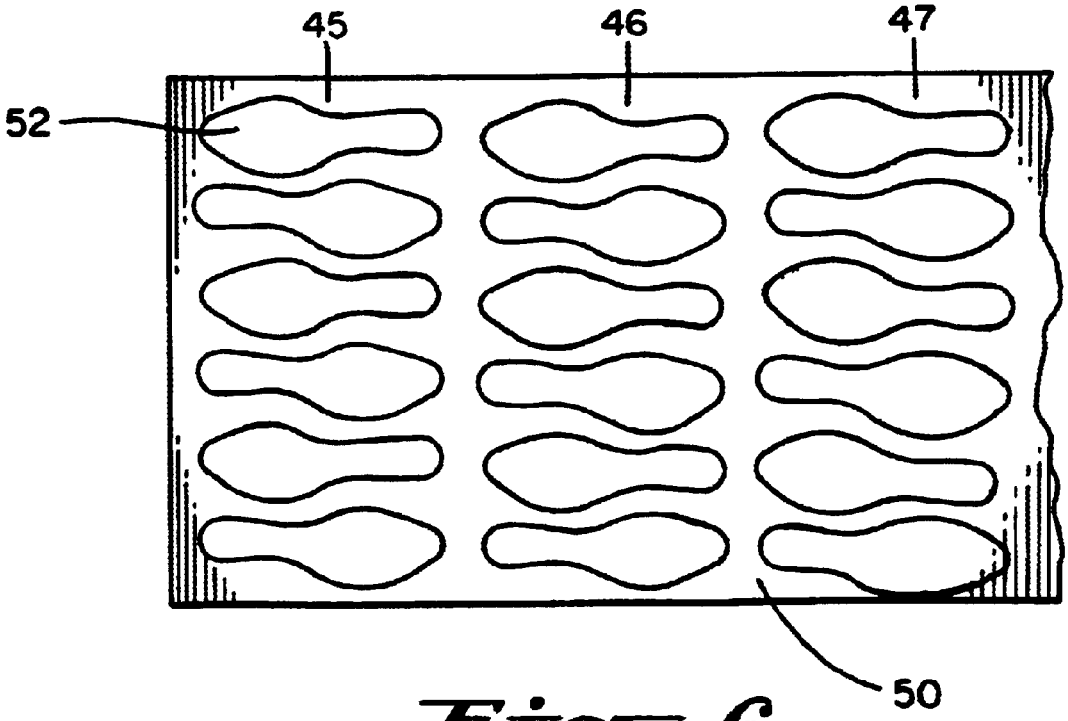
FIG. 6 is a plan view of a composite web from which the present protective foot pads are simultaneously die-cut.
Figure 7:
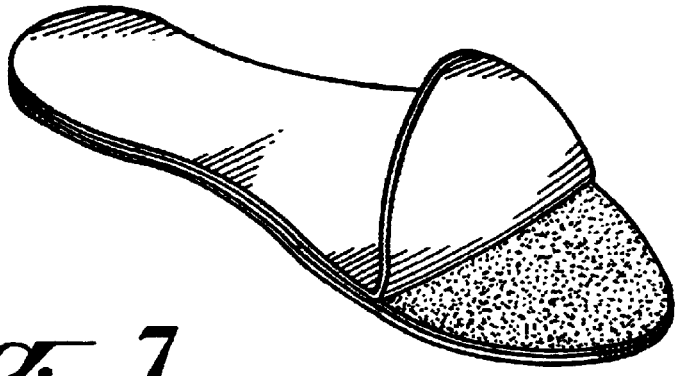
FIG. 7 is a perspective view of the present protective foot pad with the upper protective sheet partly peeled away.

Thereafter, platen 42, which carries a plurality of die-cut tools 43, arranged and shown in FIG. 6, stamps a row, such as one of rows 45, 46, and 47, from the composite web 50.

A variety of techniques can be used for removing the resulting preforms 52 from the web 50, such as vacuum, pressure blowing, and web bending.

Thereafter, the preforms 52, which are the completed protective foot pad composites, can be packaged as desired for the particular market application. That is, they can be packaged in packages of two, or simply bulk packaged, because as noted above, the pads are generic to both the left and right foot.

What is claimed is:

1. A method of making a plurality of disposable human foot protectors adapted to be adhered to the human foot without other components and with only two layers after the removal of a protective sheet, including the steps of continuously feeding a web of planar elastomeric material, applying an adhesive to one side of the web while the web is moving with a protective sheet over the adhesive layer, and simultaneously cutting a plurality of individual foot protectors from the resulting elastomeric material adhesive and protective sheet composite.

2. A method of making a plurality of disposable human foot protectors adapted to be adhered to the human foot without other components and with only two layers after the removal of a protective sheet as defined in claim 1, wherein the step of applying a protective sheet over the adhesive layer includes feeding a film with adhesive layers on both sides thereof in contact with the web of elastomeric material.

3. A method of making a plurality of disposable human foot protectors adapted to be adhered to the human foot without other components and with only two layers after the removal of a protective sheet as defined in claim 2, wherein the step of feeding a film with adhesive layers on both sides thereof includes feeding a film with adhesive layers oh both sides thereof and protector sheets over both adhesive layers, prior to contact with the web of elastomeric material, removing the protective sheet from the adhesive layer to be contacted with the web of elastomeric material, and then engaging that adhesive layer with the web of elastomeric material.

* * * * *